US010022022B2

(12) United States Patent
Del Rio

(10) Patent No.: US 10,022,022 B2
(45) Date of Patent: Jul. 17, 2018

(54) GENITALIA WASHING ASSEMBLY

(71) Applicant: Tomas Del Rio, Northlake, IL (US)

(72) Inventor: Tomas Del Rio, Northlake, IL (US)

( * ) Notice: Subject to any disclaimer, the term of this patent is extended or adjusted under 35 U.S.C. 154(b) by 297 days.

(21) Appl. No.: 14/926,756

(22) Filed: Oct. 29, 2015

(65) Prior Publication Data

US 2017/0119218 A1 May 4, 2017

(51) Int. Cl.
*A47K 1/04* (2006.01)
*A61H 35/00* (2006.01)

(52) U.S. Cl.
CPC ..... *A47K 1/04* (2013.01); *A61H 35/00* (2013.01)

(58) Field of Classification Search
CPC ..... A61H 35/00; A61H 2201/1645; A61H 2205/087; A61H 19/00; A47K 1/04; A47K 3/022; A47K 7/00; A61G 7/0005; E03D 1/003; E03D 11/025; E03D 13/00
USPC ..... 4/144.3, 619, 621; 604/347, 349, 356; 220/661, 676, 914; D3/273
See application file for complete search history.

(56) References Cited

U.S. PATENT DOCUMENTS

| | | | | |
|---|---|---|---|---|
| 2,382,368 | A * | 8/1945 | Mitchell, Jr. | B65D 5/0209 206/37 |
| 3,366,116 | A | 1/1968 | Huck | |
| 4,813,094 | A | 3/1989 | Krotine | |
| 4,974,730 | A | 12/1990 | Deruysscher | |
| D340,280 | S | 10/1993 | Junca | |
| D361,432 | S * | 8/1995 | Lotti | D3/205 |
| 6,105,810 | A * | 8/2000 | Daenen | A47J 27/212 220/366.1 |
| 6,170,698 | B1 * | 1/2001 | Phelps | A47K 10/426 221/199 |
| 6,237,470 | B1 * | 5/2001 | Adams | A47J 37/101 220/573.1 |
| 6,581,775 | B1 | 6/2003 | Hagopian | |
| D621,927 | S | 8/2010 | Dominguez et al. | |
| 2003/0075551 | A1 * | 4/2003 | Dailey, III | A47K 10/20 221/45 |
| 2006/0231604 | A1 * | 10/2006 | DeBusk | B65D 71/36 229/235 |
| 2009/0088359 | A1 | 4/2009 | Denton | |
| 2012/0087972 | A1 | 4/2012 | Ballard | |

* cited by examiner

*Primary Examiner* — Huyen Le
*Assistant Examiner* — William R Klotz

(57) ABSTRACT

A genitalia washing assembly includes a container that may contain a liquid detergent. The container has an aperture extending therethrough. The aperture may insertably receive male genitalia thereby facilitating the liquid detergent to wash the male genitalia. A lid is removably coupled to the container. The lid frictionally engages the lip such that the lid closes the opening.

4 Claims, 4 Drawing Sheets

GENITALIA WASHING ASSEMBLY

BACKGROUND OF THE DISCLOSURE

Field of the Disclosure

The disclosure relates to washing devices and more particularly pertains to a new washing device for washing male genitalia in a remote location.

SUMMARY OF THE DISCLOSURE

An embodiment of the disclosure meets the needs presented above by generally comprising a container that may contain a liquid detergent. The container has an aperture extending therethrough. The aperture may insertably receive male genitalia thereby facilitating the liquid detergent to wash the male genitalia. A lid is removably coupled to the container. The lid frictionally engages the lip such that the lid closes the opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
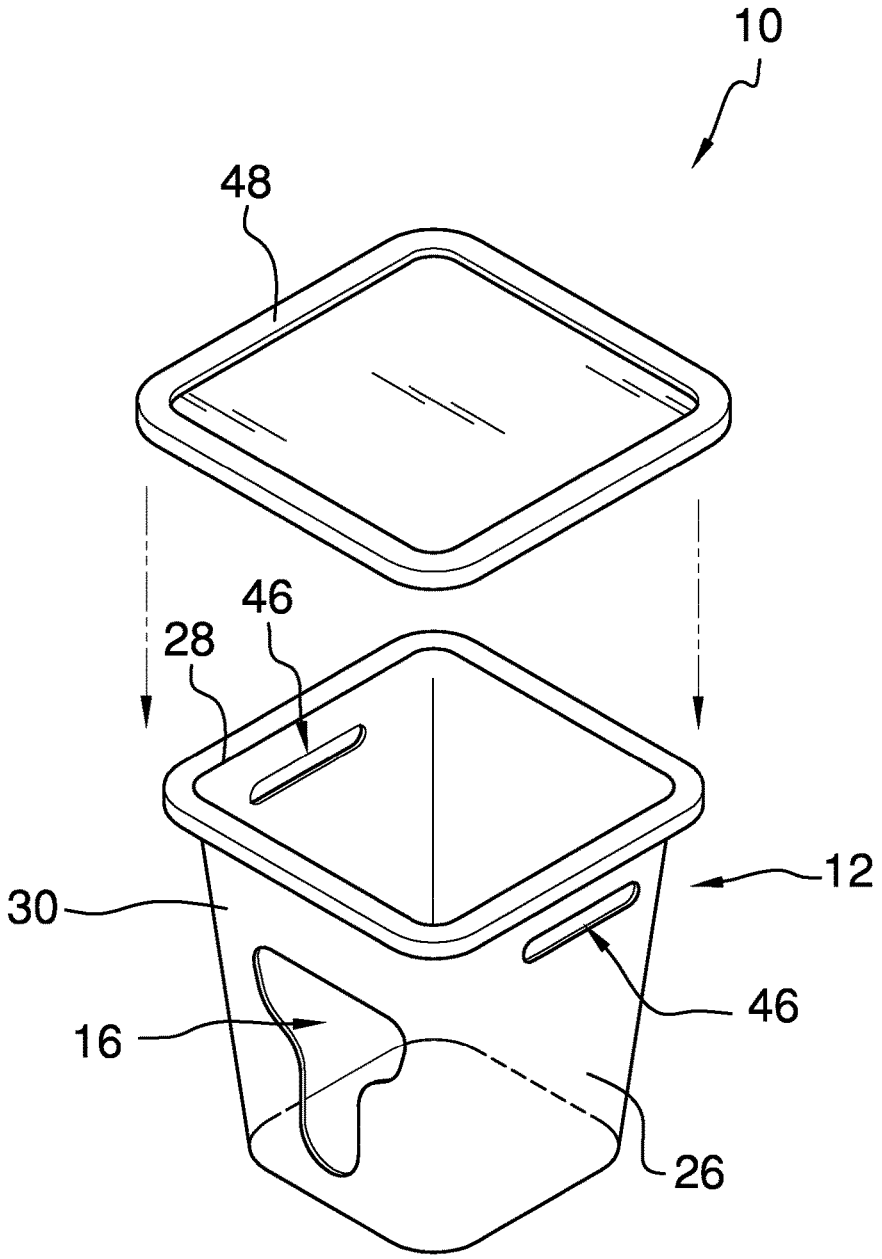
FIG. 1 is a top perspective view of a genitalia washing assembly according to an embodiment of the disclosure.
Figure 2:
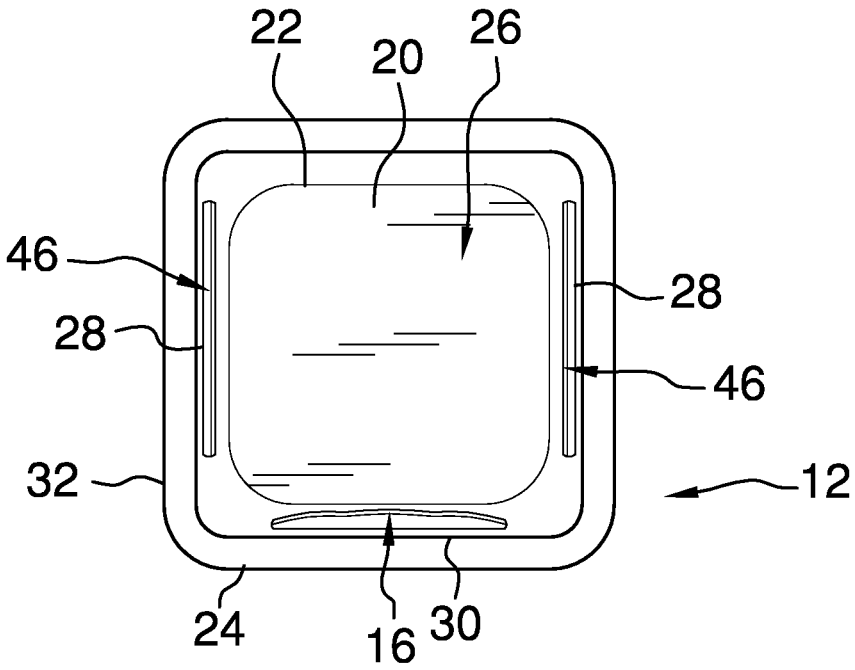
FIG. 2 is a top view of an embodiment of the disclosure.
Figure 3:
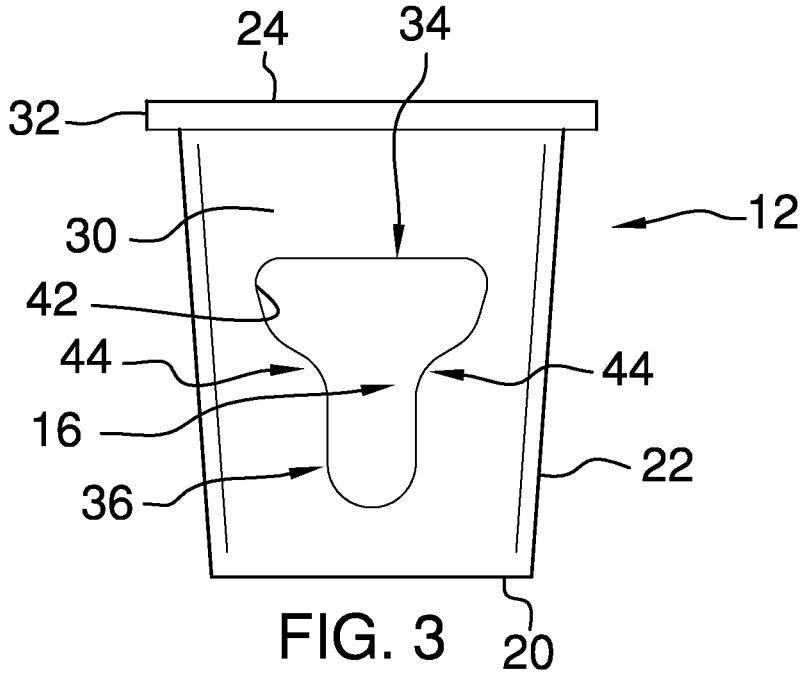
FIG. 3 is a front view of an embodiment of the disclosure.
Figure 4:
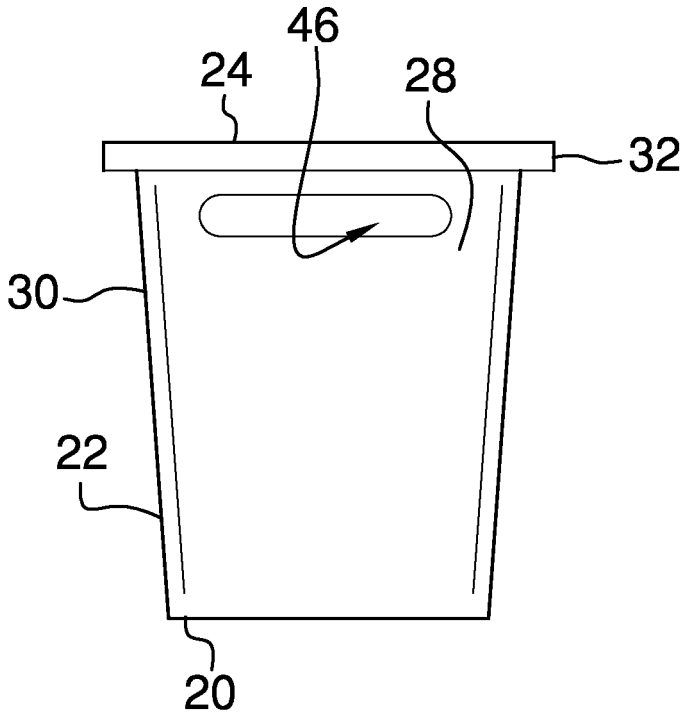
FIG. 4 is a right side view of an embodiment of the disclosure.
Figure 5:
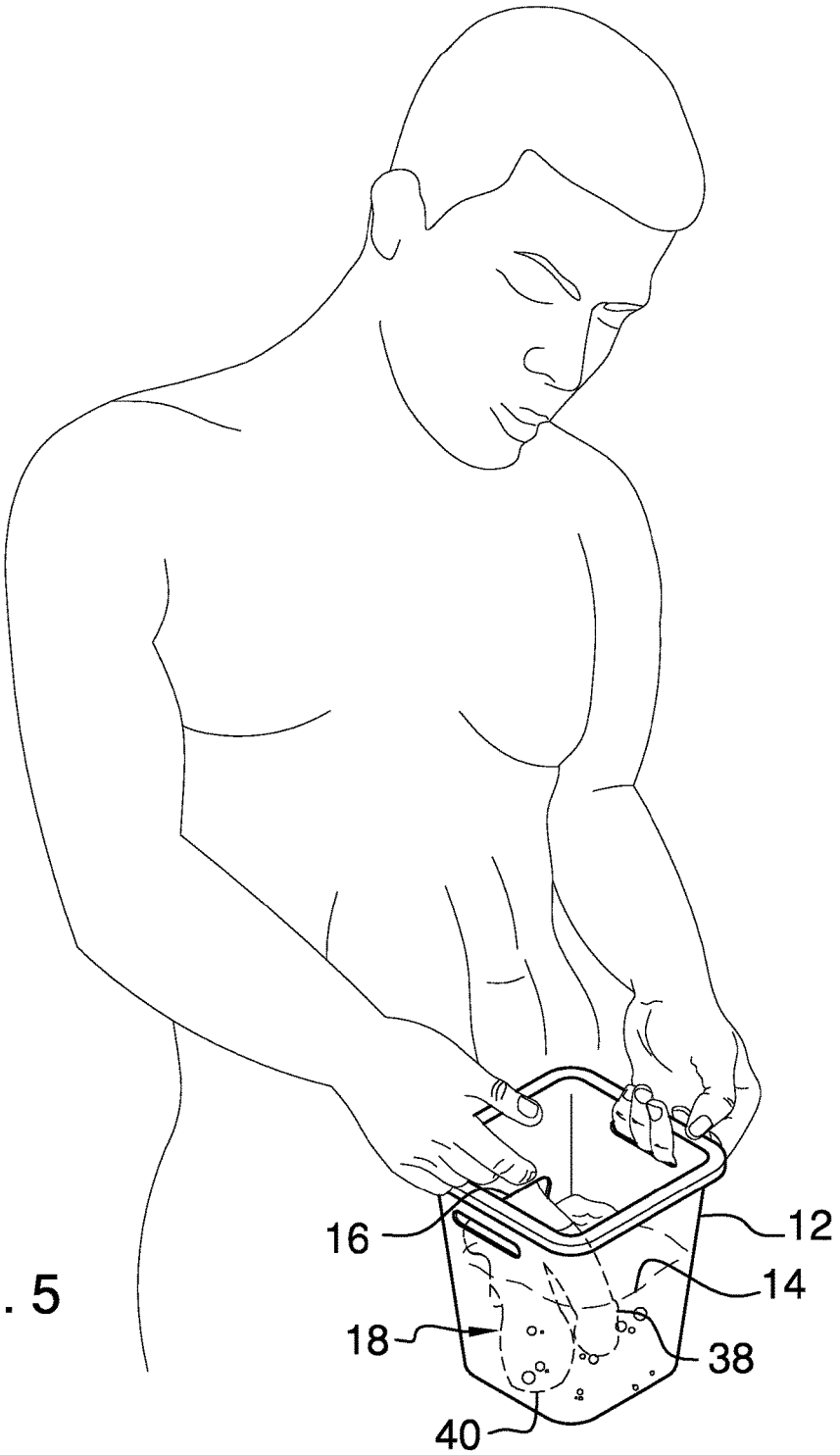
FIG. 5 is a perspective in-use view of an embodiment of the disclosure.

With reference now to the drawings, and in particular to FIGS. 1 through 5 thereof, a new washing device embodying the principles and concepts of an embodiment of the disclosure and generally designated by the reference numeral 10 will be described.

As best illustrated in FIGS. 1 through 5, the genitalia washing assembly 10 generally comprise a container 12 that may contain a liquid detergent 14. The liquid detergent 14 may comprise a soap and water mixture or other liquid detergent used to clean human skin. The container 12 has an aperture 16 extending therethrough. The aperture 16 may insertably receive male genitalia 18 thereby facilitating the liquid detergent 14 to wash the male genitalia 18. The liquid detergent 14 may comprise an antiseptic liquid detergent. Thus, the liquid detergent 14 may inhibit the male genitalia 18 from harboring bacteria.

The container 12 has a bottom wall 20 and an outer wall 22 extending upwardly from the bottom wall 20. The outer wall 22 has a distal edge 24 with respect to the bottom wall 20 to define an opening 26 into the container 12. The outer wall 22 has a pair of lateral sides 28 and a front side 30. The container 12 has a lip 32 extending outwardly from the outer wall 22 and the lip 32 is coextensive with the distal edge 24.

The aperture 16 extends through the outer wall 22 and the aperture 16 is positioned on the front side 30. The aperture 16 has a first portion 34 and a second portion 36. Each of the first portion 34 and the second portion 36 are elongated. The first portion 34 intersects the second portion 36 at a right angle such that the aperture 16 has a T shape.

The first portion 34 is horizontally oriented on the outer wall 22 such that the first portion 34 may insertably receive a penis 38. The second portion 36 is vertically oriented on the outer wall 22 such that the second portion 36 may receive a scrotum 40. The first portion 34 has a bounding edge 42 and the bounding edge 42 curves downwardly at an intersection 44 between the first portion 34 and the second portion 36. Thus, the intersection 44 has no acute angles thereby enhancing comfort of the aperture 16.

The outer wall 22 has a pair of slots 46 extending therethrough. Each of the slots 46 is positioned on an associated one of the lateral sides 28. Thus, each of the slots 46 may be gripped. Each of the slots 46 is positioned closer to the distal edge 24 than the bottom wall 20. A lid 48 is removably coupled to the container 12. The lid 48 frictionally engages the lip 32 such that the lid 48 closes the opening.

In use, the lid 48 is removed from the container 12 and each of the slots 46 is gripped. The penis 38 and scrotum 40 are inserted through the associated first portion 34 and the second portion 36 of the aperture 16. The liquid detergent 14 is poured into the container 12 when the penis 38 and scrotum 40 are inserted through the aperture 16. Thus, the penis 38 and scrotum 40 are washed. The container 12 facilitates the penis 38 and scrotum 40 to be washed in the absence of bathroom facilities. The penis 38 and the scrotum 40 are washed after participating in sexual intercourse or masturbation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A genitalia washing assembly comprising:

a container being configured to contain a liquid detergent, said container having an aperture extending therethrough wherein said aperture is configured to insertably receive male genitalia thereby facilitating the liquid detergent to wash the male genitalia, said container having a bottom wall and an outer wall extending upwardly from said bottom wall, said outer wall having a distal edge with respect to said bottom wall to define an opening into said container, said outer wall having a pair of lateral sides and a front side, said container having a lip extending outwardly from said outer wall, said lip being coextensive with said distal edge, said aperture extending through said outer wall, said aperture being positioned on said front side, said aperture having a first portion and a second portion, each of said first portion and said second portion being elongated, said first portion intersecting said second portion and extending downwardly from said second portion at a right angle such that said aperture has a T shape; and a lid being removably coupled to said container, said lid frictionally engaging said lip such that said lid closes said opening.

2. The assembly according to claim 1, wherein said first portion is horizontally oriented on said outer wall wherein said first portion is configured to insertably receive a penis, said second portion being vertically oriented on said outer wall wherein said second portion is configured to insertably receive a scrotum.

3. The assembly according to claim 1, wherein said outer wall having a pair of slots extending therethrough, each of said slots being positioned on an associated one of said lateral sides wherein each of said slots is configured to be gripped, each of said slots being positioned closer to said distal edge than said bottom wall.

4. A genitalia washing assembly comprising:

a container being configured to contain a liquid detergent, said container having an aperture extending therethrough wherein said aperture is configured to insertably receive male genitalia thereby facilitating the liquid detergent to wash the male genitalia, said container having a bottom wall and an outer wall extending upwardly from said bottom wall, said outer wall having a distal edge with respect to said bottom wall to define an opening into said container, said outer wall having a pair of lateral sides and a front side, said container having a lip extending outwardly from said outer wall, said lip being coextensive with said distal edge, said aperture extending through said outer wall, said aperture being positioned on said front side, said aperture having a first portion and a second portion, each of said first portion and said second portion being elongated, said first portion intersecting said second portion and said second portion extending downwardly from said first portion at a right angle such that said aperture has a T shape, said first portion being horizontally oriented on said outer wall wherein said first portion is configured to insertably receive a penis, said second portion being vertically oriented on said outer wall wherein said second portion is configured to insertably receive a scrotum, said outer wall having a pair of slots extending therethrough, each of said slots being positioned on an associated one of said lateral sides wherein each of said slots is configured to be gripped, each of said slots being positioned closer to said distal edge than said bottom wall; and a lid being removably coupled to said container, said lid frictionally engaging said lip such that said lid closes said opening.

* * * * *